US010062556B2

(12) United States Patent
Baba

(10) Patent No.: US 10,062,556 B2
(45) Date of Patent: Aug. 28, 2018

(54) ELECTRON INDUCED DISSOCIATION DEVICES AND METHODS

(71) Applicant: DH Technologies Development PTE Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/540,750

(22) PCT Filed: Dec. 21, 2015

(86) PCT No.: PCT/IB2015/059856
§ 371 (c)(1),
(2) Date: Jun. 29, 2017

(87) PCT Pub. No.: WO2016/108142
PCT Pub. Date: Jul. 7, 2016

(65) Prior Publication Data

US 2018/0005810 A1 Jan. 4, 2018

Related U.S. Application Data

(60) Provisional application No. 62/106,346, filed on Jan. 22, 2015, provisional application No. 62/098,019, filed on Dec. 30, 2014.

(51) Int. Cl.
*H01J 49/42* (2006.01)
*H01J 49/26* (2006.01)
(Continued)

(52) U.S. Cl.
CPC ..... *H01J 49/0072* (2013.01); *H01J 49/063* (2013.01); *H01J 49/0054* (2013.01)

(58) Field of Classification Search
CPC .. H01J 49/063; H01J 49/4225; H01J 49/0072; H01J 49/0054; H01J 49/0045;
(Continued)

(56) References Cited

U.S. PATENT DOCUMENTS 6,911,650 B1 * 6/2005 Park ..... H01J 49/063 250/282
7,638,766 B1 * 12/2009 Schoen ..... H01J 49/421 250/281
(Continued)

FOREIGN PATENT DOCUMENTS

WO 2014191821 A1 12/2014

OTHER PUBLICATIONS

International Search Report and Written Opinion for PCT/IB2015/059856 dated May 4, 2016.

*Primary Examiner* — David A Vanore

(57) ABSTRACT

A method and apparatus for conducting reactions between precursor ions and reagent ions, for example, a reaction between a precursor cation and an electron, such as ECD, are disclosed. The apparatus comprises first, second, and third pathways, each of which extends at least partially along a central axis, and wherein the second central axis is orthogonal to the first and third central axes. Charged species can be introduced into the second pathway as the ions are transmitted therethrough, thereby increasing precursor ion and charged species interaction without simultaneous trapping of the species.

20 Claims, 8 Drawing Sheets

(51) Int. Cl.
*H01J 49/00* (2006.01)
*H01J 49/06* (2006.01)

(58) Field of Classification Search
CPC ..... H01J 49/065; H01J 49/26; H01J 49/421; H01J 49/42555; H01J 49/427; H01J 49/0031; H01J 49/0036; H01J 49/005; H01J 49/0063; H01J 49/0095; H01J 49/022; H01J 49/062; H01J 49/068; H01J 49/10; H01J 49/165; H01J 49/22; H01J 49/36; H01J 49/4215; H01J 49/422; H01J 49/423; H01J 49/424; H01J 49/4285; G01N 30/7233; G01N 30/8637; G01N 30/8658; G01N 30/8693
USPC ..... 250/281, 282, 288, 283, 289, 292, 290, 250/396 R, 489
See application file for complete search history.

(56) References Cited

U.S. PATENT DOCUMENTS 9,892,899 B2 * 2/2018 Gill ..... H01J 49/063
2003/0189171 A1 * 10/2003 Londry ..... H01J 49/0063 250/292
2008/0073508 A1 * 3/2008 Hashimoto ..... H01J 49/0045 250/288
2010/0123073 A1 5/2010 Guest et al.
2011/0012017 A1 * 1/2011 Nishiguchi ..... H01J 49/063 250/289
2011/0114835 A1 * 5/2011 Chen ..... H01J 49/0072 250/282
2011/0155902 A1 * 6/2011 Guna ..... H01J 49/4225 250/282
2012/0168619 A1 * 7/2012 Guna ..... H01J 49/4225 250/282
2013/0026360 A1 * 1/2013 Stoermer ..... H01J 49/0072 250/292
2013/0277570 A1 10/2013 Park et al.
2014/0209814 A1 7/2014 Whitehouse et al.
2014/0284470 A1 9/2014 Choi et al.
2014/0299761 A1 * 10/2014 Giles ..... H01J 49/421 250/283
2015/0008316 A1 * 1/2015 Guna ..... H01J 49/4255 250/283
2016/0126076 A1 * 5/2016 Baba ..... H01J 49/063 250/489
2016/0225593 A1 * 8/2016 Hager ..... H01J 49/4215
2017/0117124 A1 * 4/2017 Baba ..... H01J 49/0054
2017/0229298 A1 * 8/2017 Stoermer ..... H01J 49/063
2017/0370889 A1 * 12/2017 Remes ..... G01N 30/7233
2018/0005810 A1 * 1/2018 Baba ..... H01J 49/0072

* cited by examiner

ELECTRON INDUCED DISSOCIATION DEVICES AND METHODS

RELATED APPLICATIONS

This application claims priority to U.S. provisional application No. 62/098,019 filed on Dec. 30, 2014, entitled "Electron Induced Dissociation Devices and Methods," which is incorporated herein by reference in its entirety and to U.S. provisional application No. 62/106,346 filed on Jan. 22, 2015, entitled "Electron Induced Dissociation Devices and Methods," which is incorporated herein by reference in its entirety.

FIELD

The teachings herein relate to ion reaction devices, and more particularly, to methods and systems for performing electron induced dissociation (EID).

BACKGROUND

Ion reactions typically involve the reaction of either a positively or negatively charged ion with another charged species, which can be another positively or negatively charged ion or an electron. In electron induced dissociation (EID), for example, an electron is captured by an ion which can result in the fragmentation of the ion. EID has been used to dissociate bio-molecules in mass spectrometry (MS), and has provided capabilities that cover a wide range of possible applications from regular proteomics in liquid chromatography-mass spectrometer/mass spectrometer (LC-MS/MS) to top down analysis (no digestion), de novo sequencing (abnormal amino acid sequencing finding), post translational modification study (glycosylation, phosphorylation, etc.), protein-protein interaction (functional study of proteins), and also including small molecule identification.

After the first report of electron capture dissociation (ECD) using electrons having kinetic energies of 0 to 3 eV, other electron induced techniques have also been developed including electron transfer dissociation (ETD) (using reagent anions), Hot ECD (electrons with kinetic energy of 5 to 10 eV), electron ionization dissociation (EID) (electrons with kinetic energy greater than 13 eV), activated ions ECD (AI-ECD), electron detachment dissociation (EDD) (electrons with kinetic energy greater than 3 eV on negative ions), negative ETD (using reagent cations), and negative ion ECD (niECD, using electrons on negative ions), Electron Impact Excitation of Ions from Organics (EIEIO, electrons with kinetic energy greater than 3 eV on singly charged cations). ECD, ETD, Hot ECD, AI-ECD, and EIEIO are utilized for positively charged precursor ions, while others such as niECD are utilized for negatively charged precursor ions. EID can be utilized to dissociate precursor ions of both polarities, including singly charged precursors. Since their discovery, these ion reaction techniques have become very useful for analyzing biomolecular species, such as peptides, proteins, glycans, and post translationally-modified peptides/proteins. ECD, for example, allows top down analysis of proteins/peptides and de novo sequencing of them. Proton transfer reactions (PTR) can also be utilized to reduce the charge state of ions in which a proton is transferred from one charged species to another.

These electron induced dissociations are considered to be complimentary to conventional collision induced or activated dissociations (CID or CAD) and have been incorporated in advanced MS devices.

In ECD, low energy electrons (typically <3 eV) are captured by positive ions. Historically, ECD was performed in a Fourier transform ion cyclotron resonance mass spectrometer (FT-ICR) because FT-ICR generally utilizes a static electro-magnetic field for ion confinement that avoids the heating of free electrons. However, such devices required relatively long interaction times and involved large instruments that were expensive to build. Attempts to use ECD in smaller applications involving Radio Frequency (RF) ion traps have been found to cause acceleration of electrons due to the trapping RF field. As a result, the field generally turned to ETD, which used negatively charged reagent ions as the electron source, or implemented ECD in a linear RF ion trap with a magnetic field.

The usage of the term ECD in the present teachings hereinafter should be understood to encompass all forms of electron related dissociation techniques, and is not limited to the usage of ECD with electrons with kinetic energy of 0 to 3 eV. Rather, usage of the term ECD within the present teachings is representative of electron related dissociation techniques, and should be understood to include all forms of electron related dissociation phenomenon including hot ECD, EID, EDD, EIEIO, and negative ECD.

ECD and ETD conventionally require relatively long reaction times between the precursor ions and reagent ions to effect ("de-ionization" or ionization)/dissociation. Though devices have been described that perform ion reactions in a "flow through" mode in which precursor ions are continuously flowed through the reaction region, such devices typically suffer from poor reaction efficiency. For example, it was reported that ExD product ion signal/total precursor ion signal can be less than 1%. See Voinov, V. G.; Deinzer, M. L.; Barofsky, D. F. *Anal. Chem.* 2009, 81, 1238-1243. Accordingly, linear ion traps have been utilized to simultaneously trap precursor and reagent ions during the ion reaction events, for example, with the electron injection and precursor ion injection/extraction sharing the same ports (or the same end lens electrodes). Trapping operations, however, typically require multiple steps and have poor compatibility with conventional CID-based quadrupole Time-of-Flight mass spectrometers (qToF), which generally operate in a continuous flow through manner. Moreover, the duty cycle is decreased because when trapping one analyte ion population, the rest of the analytical ion beam goes unused.

Recently, a new ECD device was reported that utilizes a branched RF ion trap structure in which a low-energy electron beam can be injected orthogonally into the analytical ion beam with independent control of both the ion and electron beams. See PCT App. No. PCT/IB2014/00893, filed on May 29, 2014, which is incorporated herein by reference in its entirety. This device could operate in either "flow-through" mode or simultaneous trapping mode, though it was reported that a short ion trapping period at the region of precursor ion and electron beam intersection could increase ECD efficiency while still providing up to five ECD spectra per second when operating in an information-dependent acquisition workflow.

Accordingly, there remains a need for ECD devices and methods for operating in a pure "flow through" mode, with high ion reaction efficiency.

SUMMARY

In accordance with some various aspects of the present teachings, ECD methods and systems are provided herein for interacting precursor ions with charged species for an increased duration and/or along a substantially longer path length relative to known ion reaction devices, without simultaneously trapping the precursor ions and charged species, thereby increasing efficiency of the ion reaction and/or improving continuous or "flow through" operability and compatibility with conventional CID based processes. In various aspects, the methods and systems transmit precursor ions from their injection axis and along the injection axis of the reagent species (e.g., charged species, ions, electrons, protons) before exiting the ion reaction apparatus. In some embodiments, continuous or "flow through" ion reactions can be performed so that an optimum duty cycle for ToF measurement is realized.

In accordance with various aspects of the present teachings, an ion reaction apparatus is provided, the ion reaction apparatus comprising a first plurality of electrodes arranged to define a first pathway therebetween, the first pathway comprising a first axial end configured to receive ions from an ion source and a second axial end disposed at a distance from the first axial end of the first pathway extending at least partially along a first central axis; a second plurality of electrodes arranged to define a second pathway extending along a second central axis, said second pathway intersecting the first pathway at a first intersection point, the second central axis being substantially orthogonal to the first central axis; and a third plurality of electrodes arranged to define a third pathway therebetween, the third pathway comprising a first axial end and a second axial end disposed at a distance from the first axial end of the third pathway to transmit at least one of ions and reaction products of said ions out of the ion reaction apparatus, said third pathway extending at least partially along a third central axis substantially orthogonal to the second central axis and intersecting the second pathway at a second intersection point spaced a distance apart from the first intersection point. The first, second, and third plurality of electrodes are configured to couple to an RF voltage source that provides an RF voltage to each of the electrodes of the first, second, and third plurality of electrodes. The apparatus can also include a charged species source for introducing a charged species into the second pathway along the second central axis extending between the first and second intersection points. In various aspects, the apparatus enables the ions to interact with the charged species substantially along the second pathway so as to cause electron capture dissociation, for example. By way of non-limiting example, the interaction length between the ions and the charged species can be increased relative to known ECD devices operating in a flow through mode, wherein the interaction length is at least about 10 mm.

In various aspects of the present teachings, the first central axis and the third central axis can be parallel. Additionally or alternatively, the first central axis and the second central axis can extend through the first intersection point, and the second central axis and the third central axis can extend through the second intersection point. In various aspects, the first axial end of the first pathway and the second axial end of the third pathway can be collinear.

The charged species source can have a variety of configurations in accordance with the present teachings. By way of example, the second pathway can extend between a first axial end and a second axial end disposed at a distance from the first axial end of the second pathway, with the charged species source being disposed at or proximate one of the first or second axial end of the second pathway. Alternatively, each of the axial ends of the second pathway can have a charged species source (the same or different from one another), wherein only one of said charged species sources is operational at a time. One of the charged species sources can be an electron emitter, for example, a filament (e.g., tungsten, thoriated tungsten, or others), or a $Y_2O_3$ cathode. In various aspects, the apparatus can further comprise a magnetic field generator that generates a magnetic field parallel to and along said second central axis. In various aspects, the second pathway can include lenses disposed at or proximate at least one of the axial ends of said second pathway for focusing the charged species emitted from the charged species source. In some embodiments, the charged species can be reagent anions.

In various aspects, a laser source can be disposed at or proximate to an axial end of the second pathway opposite the charged species source, the laser source for providing energy (e.g., ultraviolet or infrared light) to said ions or said charged species. In various embodiments, the injection of photons can provide complementary dissociation techniques, such as UV photo dissociation and infrared multiphoton dissociation (IRMPD), as well as a activation means for AI-ECD.

In various aspects, the apparatus can also include an ion source (e.g., a source of cations or anions) disposed at or proximate the first axial end of said first pathway for introducing the ions along the first central axis.

The first, second, and third plurality of electrodes can have a variety of configurations in accordance with the present teachings, and can comprise solid rod-type electrodes or substantially planar electrodes (e.g., formed from a surface of a printed circuit board (PCB)). By way of example, the first plurality of electrodes can comprise a set of quadrupole electrodes arranged in a quadrupole orientation around the first central axis for guiding ions along the first pathway, the second plurality of electrodes can comprise a set of quadrupole electrodes arranged in a quadrupole orientation around the second central axis for guiding ions along the second pathway, and the third plurality of electrodes can comprise a set of quadrupole electrodes arranged in a quadrupole orientation around said third central axis for guiding ions along the third pathway.

In accordance with various aspects of the present teachings, the apparatus can further include a voltage source for providing an RF voltage to said first, second, and third plurality of electrodes to generate an RF field (e.g., along one or more of the pathways defined by the electrodes) and a controller for controlling RF voltages applied to the electrodes. In related aspects, the apparatus can further comprise a fourth plurality of electrodes arranged around the first central axis and disposed on an opposed side of the second central axis from the first plurality of electrodes. As described in detail below, at least one of the first plurality of electrodes can also comprise one of the second plurality of electrodes and at least one of the fourth plurality of electrodes can also comprise one of the second plurality of electrodes. In some aspects, the controller can be configured to deliver voltage to the first and fourth plurality of electrodes such that: i) each electrode in the first plurality of electrodes is paired with another electrode in the first plurality of electrodes to form an electrode pair such that one electrode in each electrode pair of the first plurality of electrodes has the same polarity and is directly opposite across the first central axis of the other electrode in the electrode pair of said first plurality of electrodes, ii) each electrode in said fourth plurality of electrodes is paired with another electrode in said fourth plurality of electrodes to form an electrode pair such that one electrode in each electrode pair of said fourth plurality of electrodes has the same polarity and is directly opposite across the first central axis of the other electrode in the electrode pair of said fourth plurality of electrodes, and iii) each electrode in said first plurality of electrodes is paired with an electrode in said fourth plurality of electrodes to form an electrode pair such that each electrode in each electrode pair of said first and fourth plurality of electrodes has opposite polarity and is directly opposite across the first intersection point of the other electrode in the electrode pair of said first and fourth plurality of electrodes, and iv) wherein the RF fields generated between said first intersection point and said first plurality of electrodes is in reverse phase to the RF fields generated between said first intersection point and said fourth plurality of electrodes. In some aspects, the RF fields generated are at a frequency of between about 400 kHz to 1.2 MHz (e.g., about 800 kHz). In some aspects, the RF field can be 100-500V peak to peak, though a greater or lower amplitude RF signal can be utilized in accordance with the present teachings.

In related aspects, the apparatus can further comprise a fifth plurality of electrodes arranged around said third central axis and disposed on an opposed side of the third central axis from the third set of electrodes, and optionally, wherein at least one of the third plurality of electrodes also comprises one of the second plurality of electrodes and wherein at least one of the fifth plurality of electrodes also comprises one of the second plurality of electrodes. In a related aspect, the controller can be configured to deliver voltage to the third and fifth plurality of electrodes such that: i) each electrode in said third plurality of electrodes is paired with another electrode in said third plurality of electrodes to form an electrode pair such that one electrode in each electrode pair of said third plurality of electrodes has the same polarity and is directly opposite across the third central axis of the other electrode in the electrode pair of said third plurality of electrodes, ii) each electrode in said fifth plurality of electrodes is paired with another electrode in said fifth plurality of electrodes to form an electrode pair such that one electrode in each electrode pair of said fifth plurality of electrodes has the same polarity and is directly opposite across the third central axis of the other electrode in the electrode pair of said fifth plurality of electrodes, iii) each electrode in said third plurality of electrodes is paired with an electrode in said fifth plurality of electrodes to form an electrode pair such that each electrode in each electrode pair of said third and fifth plurality of electrodes has opposite polarity and is directly opposite across the second intersection point of the other electrode in the electrode pair of said third and fifth plurality of electrodes, and iv) the RF fields generated between said second intersection point and said third plurality of electrodes is in reverse phase to the RF fields generated between said second intersection point and said fifth plurality of electrodes.

In accordance with some aspects, the apparatus can further include a gate electrode disposed at the first axial end of the first pathway for controlling the introduction of said ions, an electrode disposed at said second axial end of the first pathway, said electrode having a DC potential applied thereto of the same polarity as said ions (e.g., so as to repel the introduced ions), a gate electrode disposed at the second axial end of the third pathway for controlling the removal of at least one of said ions and reaction products of said ions, and an electrode disposed at the first axial end of the third pathway, the gate having a DC potential applied thereto of the same polarity as said ions (e.g., so as to repel the ions or reaction products of the ions). In some embodiments, the gate electrode(s) can be switchable between open and closed positions, wherein when in an open position, ions or products of ion reactions are allowed to pass and when in a closed position, the ions or products of ion reactions are not allowed to pass. The controller can also control the amount of time when the gate is open and when the gate is closed. In some embodiments, for example, the gate(s) can be continuously open.

In accordance with various aspects of the present teachings, a method for performing an ion reaction is provided, the method comprising: introducing a plurality of ions into a first pathway extending at least partially along a first central axis and defined by a first plurality of electrodes, the first pathway comprising a first axial end configured to receive ions from an ion source and a second axial end disposed at a distance from the first axial end of the first pathway; transmitting the ions into a second pathway extending along a second central axis and defined by a second plurality of electrodes, said second pathway intersecting the first pathway at a first intersection point, the second central axis being substantially orthogonal to the first central axis; transmitting the ions into a third pathway extending along a third central axis and defined by a third plurality of electrodes, said third pathway intersecting the second pathway at a second intersection point spaced a distance apart from the first intersection point, the third central axis being substantially orthogonal to the second central axis; and, introducing a charged species into the second pathway along the second central axis extending between the first and second intersection points so as to allow the ions transmitted along the second pathway and the charged species to interact.

In various aspects, the method can also include providing a magnetic field parallel to said second central axis, for example, to control the path of electrons along the second pathway. In some aspects, the method can additionally include focusing the charged species with lenses disposed at or proximate one or more axial ends of said second pathway. By way of non-limiting example, electron capture dissociation can be performed by transmitting positively charged precursor ions along the first and second pathways, introducing electrons along the second pathway, and transmitting the precursor ions and/or the reaction products along the third pathway. In various aspects, the third plurality of electrodes can be configured to have RF voltages applied thereto so as to selectively filter the ions to be transmitted out of the ion reaction device (e.g., to a downstream detector or mass analyzer).

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

Methods and systems for interacting precursor ions with charged species are provided herein. Whereas conventional ion reaction devices typically require the simultaneous trapping of the precursor ions and reagent ions for a duration sufficient to produce adequate ion reactions (e.g., ECD), the methods and systems described herein can enable the precursor and reagent ions to interact for an increased duration and/or along a substantially longer path length without trapping, thereby increasing efficiency of the ion reaction and/or improving continuous or "flow through" operability and compatibility with conventional CID-based processes. In various aspects, precursor ions, which initially enter the ion reaction device along an injection axis, are transmitted along the injection axis of the reagent species (e.g., charged species, ions, electrons, protons) before exiting the ion reaction apparatus. In some embodiments, continuous or "flow through" ion reactions can be performed so that an optimum duty cycle for ToF measurement is realized. In various aspects, the apparatus comprises first, second, and third pathways, each of which extends at least partially along a central axis, and wherein the second central axis is orthogonal to the first and third central axes. Precursor ions entering the ion reaction device along the first axis can then be introduced into the second pathway as reagent ions are transmitted therethrough, thereby increasing the possibility of ion reactions occurring within the ion reaction device without simultaneous trapping of the species.

Figure 1:
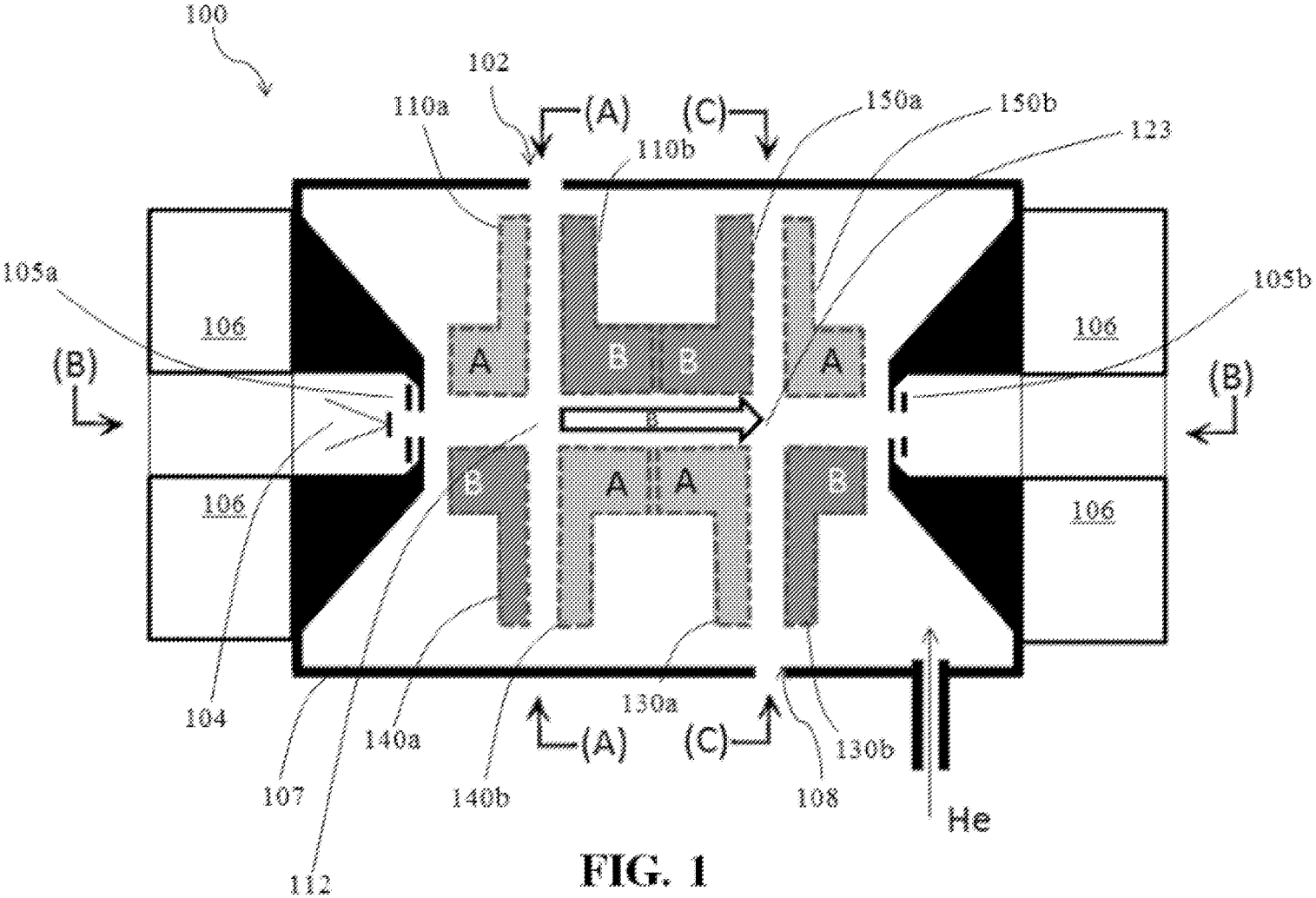
FIG. 1 illustrates schematically a top cross sectional view of an ion reaction device in accordance with aspects of various embodiments of the present teachings, the ion reaction device having an exemplary charged species source configured to transmit a charged species along a portion of the ion reaction device for enabling an ion reaction therein.

With reference now to FIGS. 1-5, an exemplary ion reaction device 100 in accordance with various aspects of the present teaching is depicted in schematic view. The exemplary ion reaction cell generally comprises an inlet 102 configured to receive precursor ions from an ion source (not shown), a plurality of electrodes for guiding the precursor ions along a variety of pathways through the generation of RF fields, a charged species source 104 for generating the reagent ions with which the precursor ions are to be reacted, and an outlet for transmitting the ions (precursor ions or products ions following the reaction to a downstream mass analyzer or detector). Optionally, and as shown in FIG. 1, the ion reaction device 100 can additionally include a magnetic field generator 106 (e.g., a permanent or electromagnet) for generating a magnetic field within the ion reaction device 100. Optionally, energy in the form of photons or light can be added for AI-ECD, typically in the form of light obtained from a laser source (not shown), for example, that generates light in the ultraviolet or infrared portion of the spectrum to perform complementary dissociation techniques such as UV photo dissociation and infrared multiphoton dissociation (IRMPD). As shown in FIG. 1, the ion reaction cell 100 can also be housed within a vacuum chamber 107 (e.g., at sub-atmospheric pressures), with a gas such as helium (He) or nitrogen ($N_2$) being added to slow the ions' movement within the reaction cell. Typically, the pressure of the cooling gas can be between $10^{-2}$ to $10^{-4}$ Torr, by way of non-limiting example.

Inside the ion reaction cell 100, the precursor ions are transmitted along a first pathway extending along a central axis (A), guided by the RF fields generated by the electrodes surrounding the first pathway and towards a first intersection point 112, upon which the precursor ions continue along the central axis (A) due to their momentum or are deflected to follow a second pathway extending along a second central axis (B) transverse or orthogonal to the first axis (A). As discussed otherwise herein, an electrode can be disposed at the axial end of the first pathway opposite the inlet 102 that can have a DC voltage applied thereto so as to repel (e.g., slow down the ions introduced into the reaction cell 100 along the first pathway). By way of example, if the precursor ions are cations, the electrode can be maintained at a positive DC voltage such that the precursor ions are repelled back toward the intersection point 112. Likewise, a gate electrode at the inlet 102 can be biased positive relative to the electrodes surrounding the central axis (A) of the first pathway such that ions that have already been injected are prevented from being ejected through the inlet 102.

As a result of the above-described forces acting on the precursor ions in the first pathway, precursor ions continuously introduced into the first pathway lose kinetic energy (e.g., through repulsion by the gate/blocking electrodes and interaction with the cooling gas), and are thus introduced (e.g., leak) into the second pathway along the second central axis (A), which is also surrounded by a plurality of electrodes that focus the precursor ions along the second central axis (B). By way of example, the precursor ions can be weakly trapped by the reagent ion beam or cloud that is injected into the second pathway by the charged species source 104 along the second central axis (B) disposed at an axial end of the second pathway. Accordingly, the precursor ions, charged species (and optionally the photons generated by the light source) interact while the precursor ions traverse the second pathway. Depending on the nature of reactants utilized, the interaction can cause a number of phenomenon to occur which result in the formation of product ions, which can then be extracted or ejected from the ion reaction cell 100 together with potentially other unreacted precursor ions through the outlet 108 of the third pathway. For example, at the second intersection point 123, (e.g., the intersection between the second central axis (B) and the third central axis (C) that is orthogonal thereto), the precursor or product ions can enter the third pathway under the influence of an electrode disposed at the axial end of the third pathway opposite the outlet 108. By way of example, the electrode can have a DC voltage applied thereto so as to repel the precursor ions toward the outlet, while a gate electrode at the outlet 108 can be biased relative to the electrodes surrounding the third pathway so as to promote the extraction of the precursor or product ions from the ion reaction cell 100. By way of example, if the precursor and/or product ions are cations, the electrode can be maintained at a positive DC voltage such that the precursor ions are repelled back toward the intersection point 123, while the gate electrode at the outlet 108 can be biased negative relative to the electrodes surrounding the central axis (C) of the third pathway such that ions at the second intersection point 123 tend to move toward the outlet 108. As will be appreciated by a person skilled in the art, the ions extracted from the ion reaction device 100 can then be subjected to further analysis or detection by a downstream element of a mass spectrometry system. Because of the increased path length and/or duration of the precursor ions with the charged species (e.g., electrons, reagent ions) along the second pathway (i.e., along central axis (B)), ions can be continuously introduced and extracted from the outlet 108 of the ion reaction cell 100, without requiring ions to be trapped within the ion reaction device 100. In various aspects, not only does the increased interaction length increase reaction efficiency (i.e., more precursor ions undergo an ion reaction), it should be appreciated that the lack of a trapping step avoids bunching the ions, thereby improving compatibility with conventional CID-based processes and/or relatively high-volume sample sources (e.g., liquid chromatography with relatively high volumetric flow rates).

Generally, the ion source (not shown) is configured to generate precursor ions, which can be received by the ion reaction device 100 for reaction with the charged species generated by the charged species source. It will be appreciated in light of the present teachings that the ion source can be any ion source known in the art or hereafter developed and modified in accordance with the present teachings, including for example, a continuous ion source, a pulsed ion source, an electrospray ionization (ESI) source, an atmospheric pressure chemical ionization (APCI), atmospheric pressure photo-ionization (APPI), direct analysis in real time (DART), desorption electrospray (DESI), source, an inductively coupled plasma (ICP) ion source, a matrix-assisted laser desorption/ionization (MALDI) ion source, a glow discharge ion source, an electron impact ion source, a chemical ionization source, or a photoionization ion source, among others. By way of non-limiting example, the sample can additionally be subjected to automated or in-line sample preparation including liquid chromatographic separation.

Generally, the precursor ions can be any ion that is positively charged (cations) or negatively charged (anions), and the charged species can be electrons or ions that are either positively or negatively charged and capable of reacting with the precursor ions. By way of example, when the ions are cations and the charged species are electrons, the cations may capture the electrons and undergo electron capture dissociation in which the interaction between ions and charged species results in the formation of product ions, or fragments of the original precursor ions. The stream of species ejected from the ion reaction cell can consist of one or more or a mixture of the precursor ions, the product ions, and in some cases, the charged species. In addition, it will be appreciated by a person skilled in the art that various electron associated fragmentation phenomena can be performed in methods and systems in accordance with the present teaching such as hot ECD, electron ionization dissociation (EID), activated ions ECD (AI-ECD), electron detachment dissociation (EDD), EIEIO, and negative ion ECD. For example, ECD and hot ECD can be implemented when the precursor ions are cations, while EID can be used if the precursor ions are anions, for example. Proton transfer reactions can also be implemented with the appropriate selection of a charged species, as understood by a person skilled in the art in light of the present teachings.

When the charged species are electrons, for example, the electron source 104 can be a filament such as a tungsten or thoriated tungsten filament or other electron source such as a $Y_2O_3$ cathode. The filament electron source is typically used because it is inexpensive but it is not as robust on oxygen residual gas. $Y_2O_3$ cathodes on the other hand are expensive electron sources but are more robust on oxygen so it is useful for de novo sequencing using radical-oxygen reaction. In operation, an electric current of 1 to 3 A is typically applied to heat the electron source, which produces 1 to 10 W heat power. A heat sink system of the electron source can be installed to also keep the temperature of a utilized magnet, if present, lower than its Curie temperature, at which the magnetization of permanent magnet is lost. Other known methods of cooling the magnet can also be utilized.

With specific reference again to FIG. 1, in a cross-sectional schematic view, the exemplary reaction device comprises an outer housing 107 containing various electrodes for controlling the movement of ions through the ion reaction device 100. The outer housing 107 is configured to couple to the ion source (not shown) and receive the precursor ions at the inlet end 102 of the first pathway extending along the first central axis (A) defined by a plurality of electrodes 110*a-d*, 140*a-d*. This pathway provides a path for ions to enter into the ion reaction apparatus 100. As discussed in detail below, each end of the first pathway can include an electrode to which DC voltages can be applied for example, for controlling the axial movement of ions within the first pathway.

Figure 4:
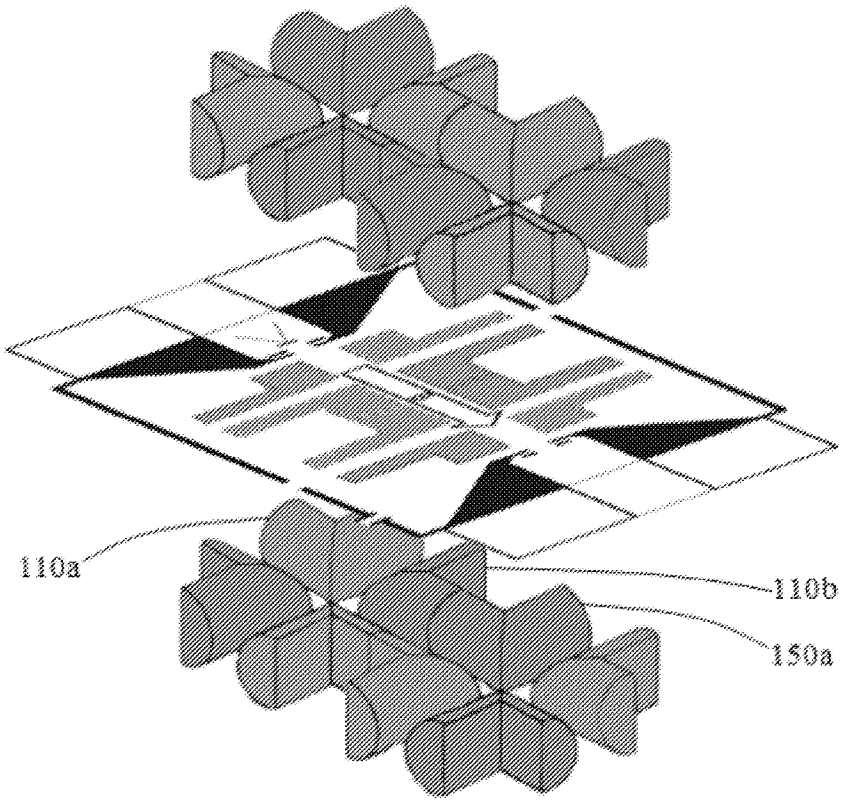
FIG. 4 illustrates schematically another view of the ion reaction device of FIG. 1.
Figure 2:
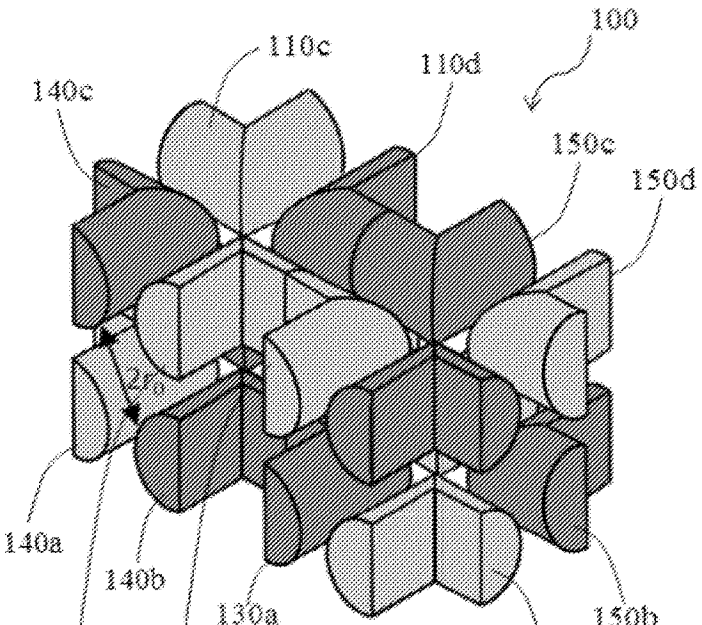
FIG. 2, in schematic view, illustrates an exemplary plurality of quadrupole electrodes for use in the ion reaction device of FIG. 1.
Figure 3:
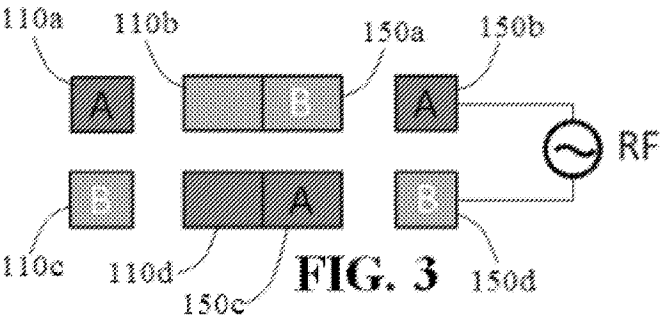
FIG. 3, in schematic view, illustrates the exemplary potentials applied to some of the plurality of electrodes for generating RF fields along a pathway through the ion reaction device.

The exemplary apparatus 100 comprises a first plurality of generally L-shaped electrodes 110*a-d* arranged around the first central axis (A) in a quadrupole type arrangement. While quadrupoles are specifically embodied here, any arrangements of multipoles could also be utilized, including hexapoles, octapoles, etc. In FIG. 1, only two of the four quadrupole electrodes 110*a,b* are depicted, the other two electrodes 110*c,d* being directly above the depicted electrodes (see FIGS. 2 and 4). As shown in FIG. 3, the electrodes 110*a-d* are connected to a RF voltage source and controller (not shown), which serve to provide RF voltages to the electrodes 110*a-d* to generate an RF field therebetween to guide the ions towards the first central axis (A) (e.g., the midpoint of the quadrupoles). By way of example, each electrode in the first plurality of electrodes 110*a-d* can have an RF voltage applied thereto such that each electrode is directly opposite across the first central axis (A) of another electrode of the first set of electrodes having the same polarity. That is, as best shown in FIG. 4, electrode 110*b* has the same polarity as electrode 110*c*. The RF frequencies applied to the quadrupoles can be in the range of around 400 kHz to 1.2 MHz (e.g., about 800 kHz), all by way of non-limiting example.

With reference again to FIG. 1, the first pathway extending along the central axis (A) can also be surrounded by an additional set of electrodes 140*a-d* (only two of which are shown in FIG. 1) that are separated from the first plurality of electrodes 110*a-d* by a small distance (i.e., by the width of the second pathway extending along the second central axis (B)). For convenience, this set of electrodes 140*a-d* will be referred to herein as the fourth set of electrodes.

Like the electrodes 110*a-d*, the fourth set of electrodes 140*a-d* can be connected to the RF voltage source and controller, which also serve to provide RF voltages to the electrodes 140*a-d* to generate an RF field therebetween to guide the ions towards the first central axis (A) (e.g., the midpoint of the quadrupoles). By way of example, each electrode in the fourth set of electrodes 140*a-d* can have an RF voltage applied thereto such that each electrode in the fourth set of electrodes 140*a-d* is directly opposite across the first central axis (A) of another electrode of the fourth set of electrodes having the same polarity. That is, as best shown in FIGS. 2 and 4, electrode 140*a* has the same polarity as electrode 140*c*. Moreover, each electrode in the first and fourth sets of electrodes 110*a-d*, 140*a-d* can be directly opposite across the first intersection point 112 from an electrode of the other set of electrodes having the opposite polarity. For example, as best shown in FIGS. 2 and 4, electrode 140*a* has the opposite polarity of electrode 110*d*.

Figure 5:
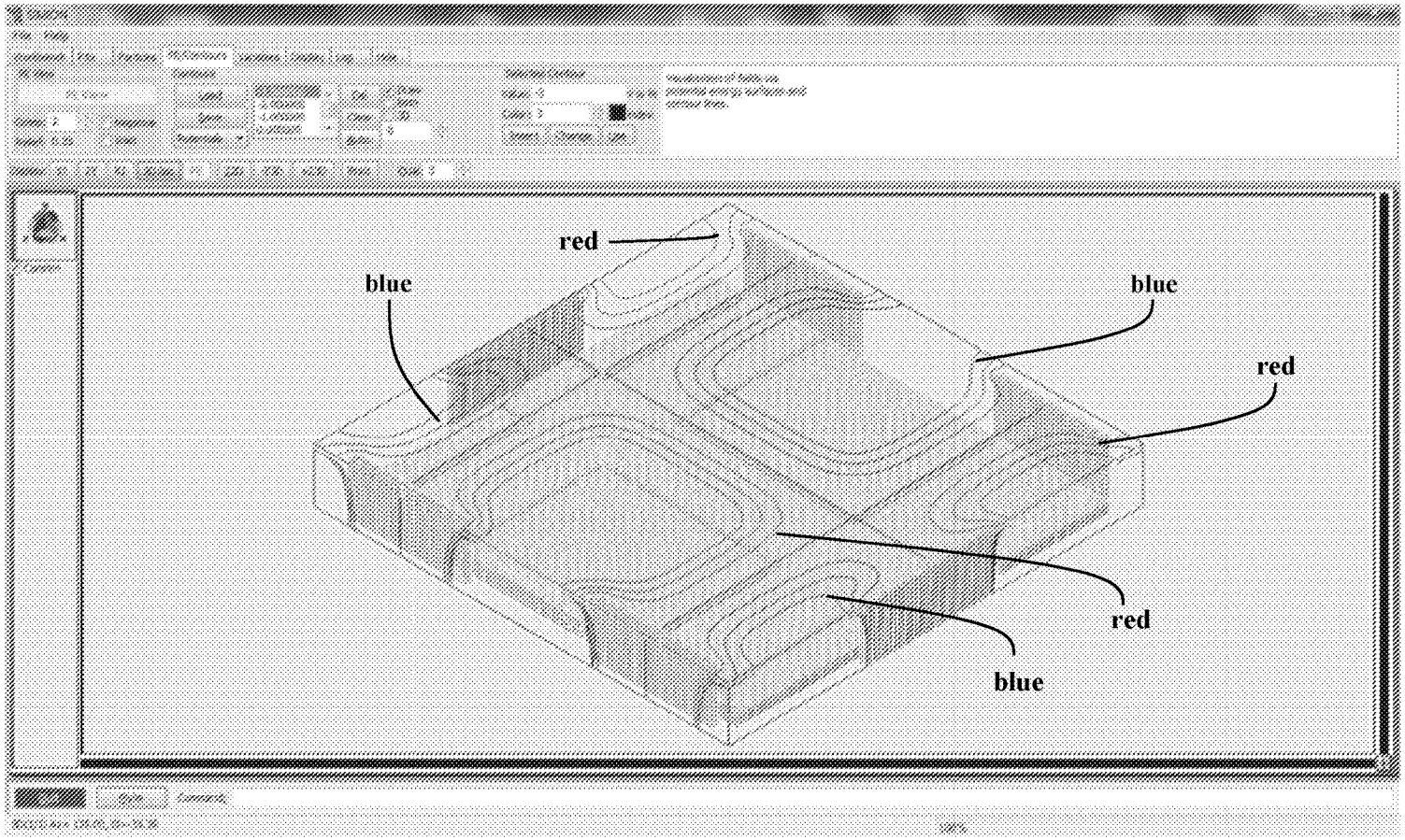
FIG. 5 illustrates a SIMEON model of the exemplary RF field produced by the plurality of electrodes in the apparatus of FIG. 1.

As shown in FIG. 5, the above configuration of the first set of electrodes 110*a-d* and the fourth set of electrodes 140*a-d* results in the generation of RF fields along the first pathway that focus the ions about the first central axis (A) (e.g., no RF field is present on the first central axis (A)) and such that the RF field generated between the first intersection point 112 and the first set of electrodes 110*a-d* to be in reverse phase to the RF field generated between the first intersection point 112 and the fourth set of electrodes 140*a-d*.

As noted above, the separation distance between the first set of electrodes 110*a,d* and the fourth set of electrodes 140*a,d* forms a small gap therebetween which also represents a portion of the second pathway extending along the second central axis (B). This second pathway provides a path for the transport of a charged species within the ion reaction device 100. As shown in FIG. 1, the first and second pathway are substantially orthogonal to one another and meet at an intersection point 112, this intersection point being along the first central axis (A) and second central axis (B). Further, as shown in FIG. 1, the second pathway is also defined by L-shaped electrodes arranged around the second central axis (B) in a quadrupole type arrangement, which for convenience are referred to herein as the second set of electrodes. Again, while quadrupoles are specifically depicted, any arrangements of multipoles could also be utilized, including hexapoles, octapoles, etc. Specifically, the second set of electrodes in the depicted configuration comprises electrodes 110*b,d* (also members of the first set of electrodes), 140*b,d* (also members of the fourth set of electrodes), electrodes 130*a,c* (also members of a third set of electrodes), and electrodes 150*a,c* (also members of a fifth set of electrodes). In FIG. 1, only four of the eight quadrupole electrodes in the second set are depicted, the other four electrodes being directly above the depicted electrodes (see FIGS. 2 and 4). As shown in FIG. 3, the electrodes of the second set of electrodes are connected to a RF voltage source and controller, which serve to provide RF voltages to the second set of electrodes to generate an RF field therebetween to guide the ions towards the second central axis (B) (e.g., the midpoint of the quadrupoles). By way of example, adjacent electrodes along the second central axis (B) of the second set of electrodes can have the same polarity, and electrodes directly across the second central axis (B) can also have the opposite polarity, while the other electrodes of the second set of electrodes have the opposite polarity. That is, electrode 110*d* can have the same polarity as 150*c* (indeed, these two electrodes can be considered to be a single U-shaped electrode), and the same polarity as electrodes 140*b* and 130*a*. With reference again to FIG. 5, the above configuration of the second set of electrodes results in the generation of an RF field along the second pathway that focus the ions along the second central axis (B) (e.g., no RF field is present on the second central axis (B)).

With reference again to FIG. 1, the exemplary apparatus 100 also comprises a third set of generally L-shaped electrodes 130*a-d* arranged around the third central axis (C) in a quadrupole type arrangement. While quadrupoles are specifically embodied here, any arrangements of multipoles could also be utilized, including hexapoles, octapoles, etc. In FIG. 1, only two of the four quadrupole electrodes 130*a,b* are depicted, the other two electrodes 130*c,d* being directly above the depicted electrodes (see FIGS. 2 and 4). As shown in FIG. 3, the electrodes 130*a-d* are connected to a RF voltage source and controller (not shown), which serve to provide RF voltages to the electrodes 130*a-d* to generate an RF field therebetween to guide the ions towards the third central axis (C) (e.g., the midpoint of the quadrupoles). By way of example, each electrode in the third plurality of electrodes 130*a-d* can have an RF voltage applied thereto such that each electrode is directly opposite across the third central axis (C) of another electrode of the third set of electrodes having the same polarity. That is, as best shown in FIG. 4, electrode 130*a* has the same polarity as electrode 130*d*.

With reference again to FIG. 1, the third pathway extending along the third central axis (C) can also be surrounded by an additional set of electrodes 150*a-d* (only two of which are shown in FIG. 1) that are separated from the third plurality of electrodes 130*a-d* by a small distance (i.e., by the width of the second pathway extending along the second central axis (B)). For convenience, this set of electrodes 150*a-d* will be referred to herein as the fifth set of electrodes.

Like the electrodes 130*a-d*, the fifth set of electrodes 150*a-d* can be connected to the RF voltage source and controller, which serve to provide RF voltages to the electrodes 150*a-d* to generate an RF field therebetween to guide the ions towards the third central axis (C) (e.g., the midpoint of the quadrupoles). By way of example, each electrode in the fifth set of electrodes 150*a-d* can have an RF voltage applied thereto such that each electrode in the fifth set of electrodes 150*a-d* is directly opposite across the third central axis (C) of another electrode of the fifth set of electrodes having the same polarity. That is, as best shown in FIGS. 2 and 4, electrode 150*c* has the same polarity as electrode 150*b*. Moreover, each electrode in the third and fifth sets of electrodes 130*a-d*, 150*a-d* can be directly opposite across the second intersection point 123 from an electrode of the other set of electrodes having the opposite polarity. For example, as best shown in FIGS. 2 and 4, electrode 150*c* has the opposite polarity of electrode 130*b*.

Thus, as depicted in FIG. 5, the above configuration of the third set of electrodes 130*a-d* and the fifth set of electrodes 150*a-d* results in the generation of RF fields along the third pathway that focus the ions about the third central axis (C) (e.g., no RF field is present on the third central axis (C)) and such that the RF field generated between the second intersection point 123 and the third set of electrodes 130*a-d* to be in reverse phase to the RF field generated between the second intersection point 123 and the fifth set of electrodes 150*a-d*.

With specific reference again to FIG. 1, the outer housing 107 can provide an outlet 108 disposed on the third central axis (C) for transmitting ions out of the ion reaction device 100 to a downstream mass analyzer or detector for further analysis of the precursor ions and/or the product ions that result from the interaction between the precursor ions and the charged species along the second pathway, for example. That is, the third pathway provides a path for ions to exit the ion reaction apparatus 100. Moreover, as discussed otherwise herein, each end of the third pathway can include an electrode to which DC voltages can be applied for example, for controlling the axial movement of ions within the third pathway. By way of example, the axial end opposite the outlet can have a DC potential of the same polarity as the precursor or product ions applied thereto such that ions at the second intersection point 123 are driven by the electrostatic potential toward the outlet 108.

As shown in FIG. 1, the axial end of the second pathway contains or has proximate to it a charged species source (e.g., an electron filament) to be used to generate charged species for transmission into and along the second pathway extending between the first and second intersection points 112, 123. Moreover, the first axial end of the second pathway can also contain or have proximate to it, a suitable electrode gate 105*a* to control the entrance of electrons into the second pathway. Additionally, a magnetic field source 106, such as a permanent magnet can be configured to generate a magnetic field that is parallel to the second pathway, as depicted schematically for example by the arrow (B). The magnetic field can also be generated by any other magnetic field generating source and can also include an electromagnetic, a neodymium magnet, or the like that functions to generate a field parallel to and in line with the second central axis (B) of the second pathway. The magnetic flux density can be any density able to implement the magnetic field to cause focusing of an electron beam and can range, for example, up to 1.5 T or higher, but preferably about 0.1 to 1.0 T. Magnets with higher density can be positioned further away from the electrode pair. A magnetic field (as indicated by the arrow B) of 0.1 T is aligned to be parallel to and along the path of electron direction. It will be appreciated in light of the present teachings that this magnetic field may be useful when ECD, hot ECD, EID, EDD and negative ECD are being implemented, for example, when the charged species are electrons. The RF field is 100-500V peak to peak and the electron beam energy is 0-100 eV at the center.

It will also be appreciated that to prevent ions from escaping from the axial ends of the second pathway, a blocking electrode (e.g., a plate electrode 105*b*) can be provided adjacent the axial ends of the second pathway, the blocking electrode being electrically connected to a suitable voltage source (e.g., a DC voltage source) such that a blocking potential of the same polarity as the ions to be analyzed/reacted can be applied thereto.

Figure 6:
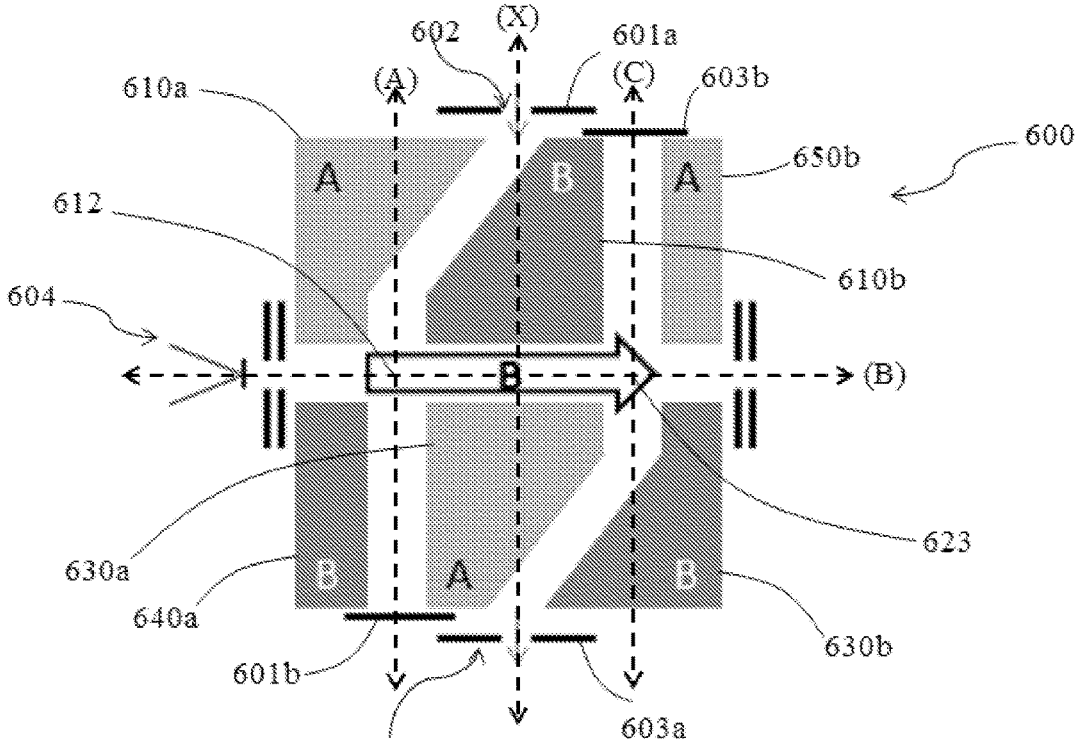
FIG. 6 illustrates another exemplary ion reaction device in accordance with various aspects of the applicant's teachings in which the ion entrance and exit of the ion reaction device are collinear.
Figure 7:
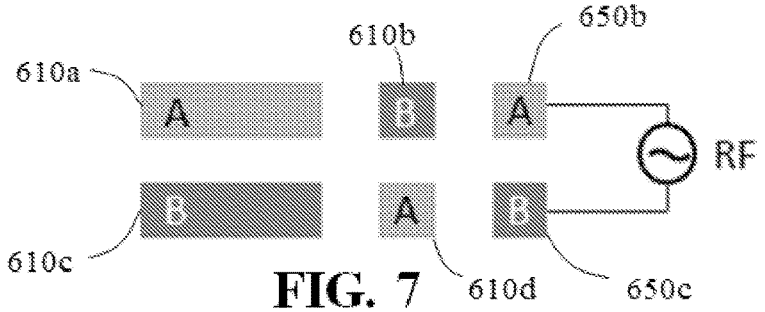
FIG. 7, in schematic view, illustrates the exemplary potentials applied to some of the plurality of electrodes for generating RF fields along a pathway through the ion reaction device of FIG. 6.

With reference now to FIGS. 6 and 7, another exemplary ion reaction device 600 in accordance with various aspects of the present teachings is schematically depicted. The ion reaction device 600 is substantially similar to that discussed above with reference to the ion reaction device 100 depicted in FIG. 1, but differs in that the inlet 602 of the first pathway and the outlet 608 of the third pathway are collinear. In this manner, the ion reaction device 600 can be placed in-line into known mass spectrometer systems, for example, such that an ion source can be coupled to the inlet 602 and mass analyzer (e.g., a ToF mass analyzer, Q3) can be coupled to the outlet end 608 (e.g., Q3) with minimal modifications to the existing MS system. Moreover, it will be appreciated that the ion reaction devices described herein can be inserted in series in between two quadrupole filters, for example, between a quadrupole filter (Q1) upstream of the ion reaction device 600 (and disposed between the ion source and the ion reaction device), serves to trap/guide/etc. ions and provides a source of ions at the entrance of the device 600, and a downstream quadrupole (Q2), which can receive product ions and unreacted ions and either trap/guide/etc. in the quadrupole for further analysis or processing.

As shown in FIG. 6, precursor ions can thus be injected along an injection/ejection axis (X) into a first pathway extending at least partially along a first central axis (A) and which intersects a second pathway extending along a second central axis (B) at a first intersection point 612, introduced into the second pathway as reagent ions are injected therein by a charged species source 604, and then enter a third pathway, which intersects the second pathway at a second intersection point 623 and extends at least partially along a third central axis (C), wherein the first (A) and third (C) central axis are substantially orthogonal to the second central axis (B). Precursor and/or product ions can also be extracted from this third pathway along the same injection/extraction axis (X).

As shown in FIGS. 6 and 7, the first pathway is defined by a first set of electrodes 610*a-d* to which RF voltages can be applied for maintaining ions transmitted therethrough substantially equidistant from the electrodes 610*a-d*. Whereas the electrodes of FIG. 1 were substantially L-shaped (and substantially parallel to the central axis (A) along its entire length), by way of example, the first pathway of the ion reaction device 600 is bent (e.g., curved) as defined by the first set of electrodes 610*a-d*. That is, though the separation between adjacent electrodes 610*a-d* remains substantially constant along their length, the electrodes 610*a-d* are shaped such that they define a non-straight pathway therebetween. Likewise, the third set of electrodes 630*a-d* (only two of which are shown in FIG. 6) can be similarly modified so as to produce a bent third pathway through which the ions traverse prior to exiting the ion reaction device. In addition to the changes in the shape of the electrodes of the second set of electrodes, each of the electrodes of the second set of electrodes also represents a member of the first and third sets of electrodes. By way of example, the electrode 610*b* functions as an RF-field generating electrode for focusing the ions along the first, second, and third central axis, depending on the location of the ion within the ion reaction device 600.

FIG. 6 additionally depicts an exemplary configuration of an inlet lens electrode 601*a*, a first pathway blocking electrode 601*b*, an outlet lens electrode 603*a*, and a third pathway blocking electrode 603*b*. As will be appreciated by a person skilled in the art, each of these electrodes can have an electrical signal applied thereto for controlling the movement of the ions axially within the first or third pathway. In an exemplary situation in which precursor cations are reacted with electrons so as to form product cations, the third pathway blocking electrode 603*b* disposed at the axial end of the third pathway opposite the outlet 608 can have a positive DC voltage applied thereto so as to repel the precursor and/or product cations toward the outlet 608, while outlet lens electrode 603*a* can be biased negatively so as to promote the extraction of the precursor or product ions from the ion reaction cell 600.

Figure 9:
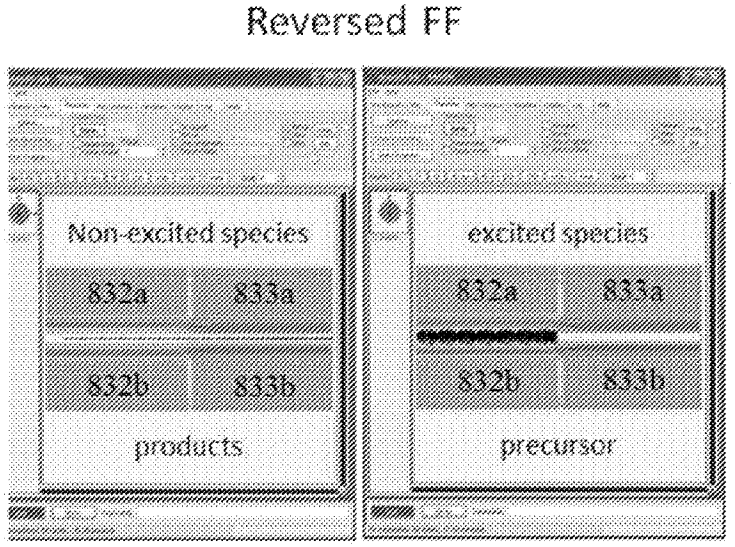
FIG. 9, in schematic view, illustrates the exemplary potentials applied to some of the plurality of electrodes for generating RF fields along a pathway through the ion reaction device of FIG. 8.
Figure 8:
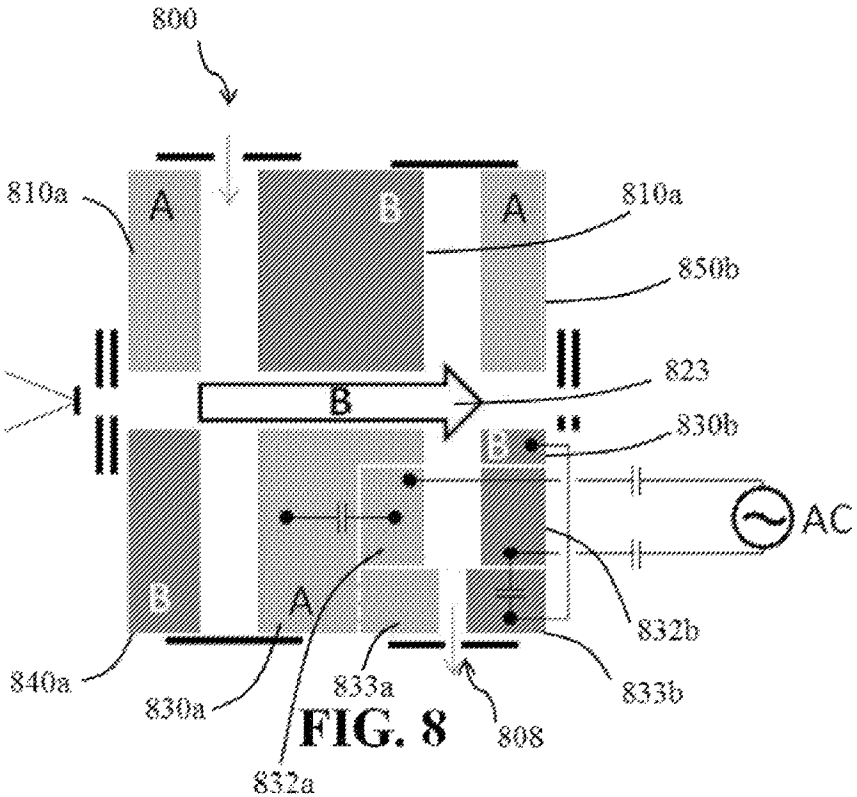
FIG. 8 illustrates another exemplary ion reaction device in accordance with various aspects of the applicant's teachings in which the ion exit of the ion reaction device is configured to filter ions transmitted therefrom utilizing a reversed fringing field.

With reference now to FIGS. 8 and 9, another exemplary ion reaction device 800 in accordance with various aspects of the present teachings is schematically depicted. The ion reaction device 800 is substantially similar to that discussed above with reference to the ion reaction device 100 depicted in FIG. 1, but differs in that selective extraction (i.e., filtering) of ions can be performed at the outlet 808 of the third pathway. In the exemplary depicted embodiment, the third pathway comprises a reduced-diameter portion adjacent the outlet 808 of the ion reaction device 800, the reduced-diameter portion being defined by additional electrodes 833*a-d* (only two of which are shown) that are coupled to an AC voltage source (not shown). Additionally, the third pathway is also defined by a set of electrodes 832*a-d* adjacent the reduced-diameter portion defining the standard diameter of the third pathway (i.e., separated by the same distance across the third central axis (C) as the electrodes 830*a*/830*b* and 810*a*/850*b*), the electrodes 832*a-d* also being coupled to the AC voltage source. By applying a supplemental AC signal at a frequency corresponding to the secular frequency of the precursor ions, the precursor ions (but not the product ions) are excited and their radial oscillation amplitude increases. When the radially-excited precursor ions reach the border between the electrodes 832*a-d* and 833*a-d*, a reversed fringing field generated thereat repulses the precursor ions while the product ions (which are being transmitted substantially along the third central axis (C)) pass through. The use of reversed fringing fields to selectively filter ions is further described in PCT App. No. PCT/IB2012/002621, entitled "Ion Extraction Method For Ion Trap Mass Spectrometry" filed on Dec. 6, 2012, which is incorporated by reference in its entirety. It will further be appreciated that the repulsed precursor ions can be cooled by a cooling gas and further traverse the ion reaction device 800 until it interacts with the charged species (e.g., about the second intersection point 823).

Figure 10:
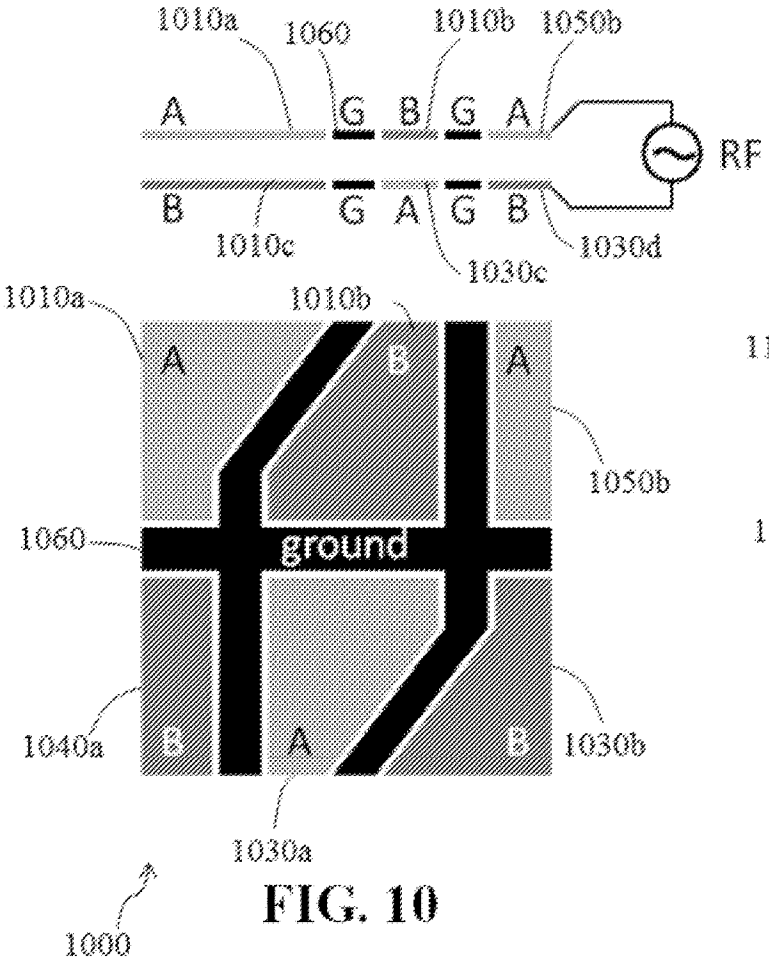
FIG. 10 illustrates an exemplary simulation of the filtering between precursor species and product ion species utilizing a reversed fringing field generated in the ion reaction device of FIG. 8.

With reference now to FIG. 10, another exemplary ion reaction device 1000 in accordance with various aspects of the present teachings is schematically depicted. The ion reaction device 1000 is similar to that discussed above with reference to the ion reaction device 600 depicted in FIG. 6, but differs in that rather than the first, second, and third pathways being defined by solid electrodes (e.g., L-shaped electrodes), the pathways are instead defined by a plurality of substantially planar electrodes, for example, formed on a printed circuit board (PCB) (only one of which is shown in FIG. 10). That is, two parallel PCBs can be disposed on opposed sides of the first, second, and third central axis such that the ions can be transmitted along the pathways therebetween. Moreover, as shown in FIG. 10, each of the electrodes can be separated by electrode portions 1060 that are grounded so as to prevent the electrons from being drawn to the non-conductive dielectric portions of the PCB along the second pathway. By way of example, the ground pads 1060 can comprise dielectric portions of the PCB coated with graphite paste.

It should be appreciated that the schematically-depicted ion reaction device 1000 can additionally or alternatively include one or more other features described herein. By way of example, the ends of the pathways can comprise electrodes for controlling the axial motion of ions therein. Moreover, as described above with reference to FIG. 1, the electrodes can define substantially straight pathways extending along the central axes substantially along their entire length.

Figure 11:
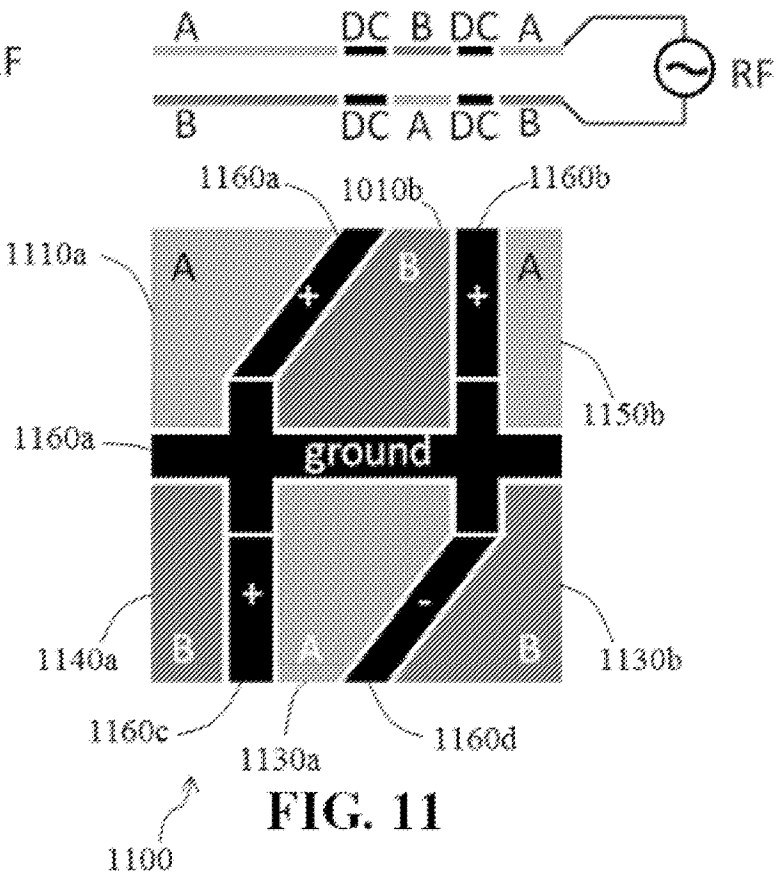
FIG. 11, in schematic view, illustrates another exemplary ion reaction device in accordance with aspects of various embodiments of the applicant's teachings in which the plurality of electrodes comprise electrically conductive surfaces of a printed circuit board (PCB).

With reference now to FIG. 11, another exemplary ion reaction device 1100 in accordance with various aspects of the present teachings is schematically depicted. The ion reaction device 1100 is similar to that discussed above with reference to FIG. 10, but differs in that the ground pads can be segmented such that pads 1160*a-d* can have DC biases applied thereto. By way of example, pads 1160*a-c* can be biased positively such that ions are accumulated about the second pathway, while the pad 1160*d* is biased negatively to promote extraction of precursor and/or product ions.

Figure 12A:
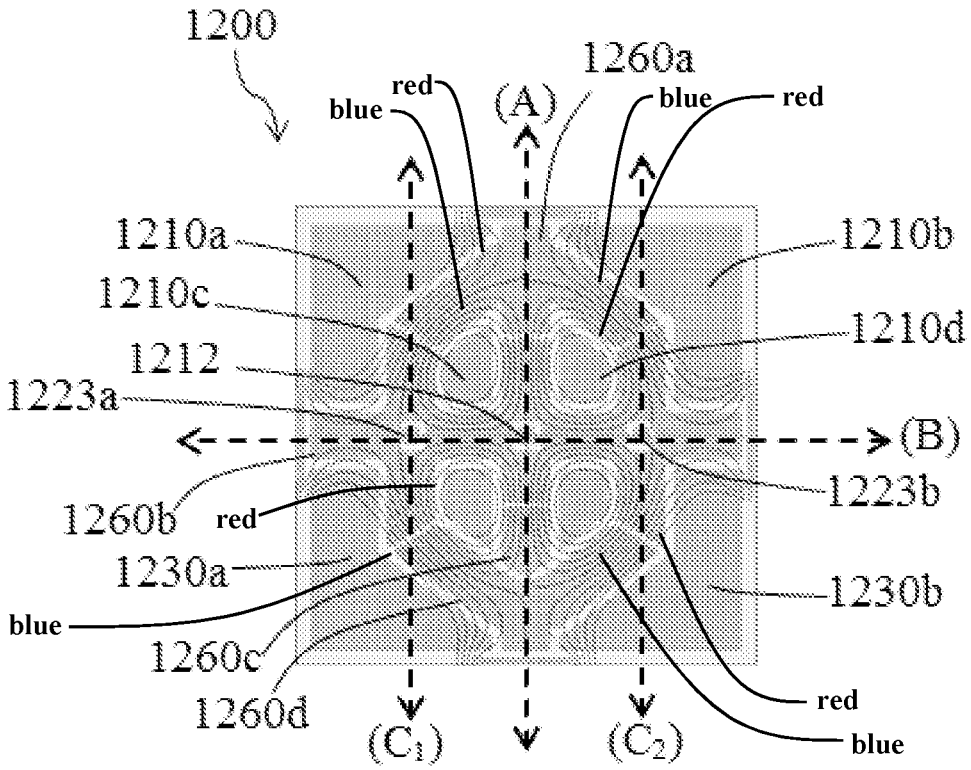
FIG. 12, in schematic view, illustrates another exemplary ion reaction device in accordance with aspects of various embodiments of the applicant's teachings in which the plurality of electrodes comprise electrically conductive surfaces of a printed circuit board (PCB).
Figure 12B:
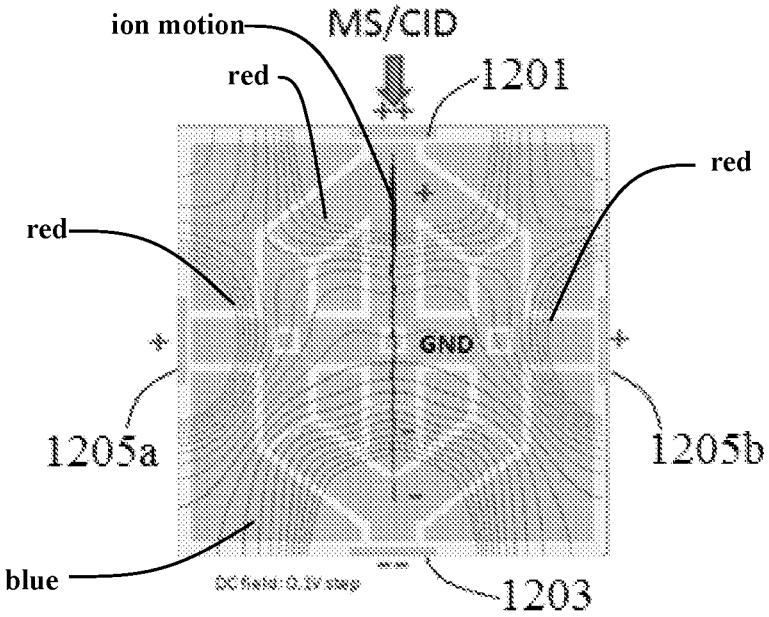
Figure 12C:
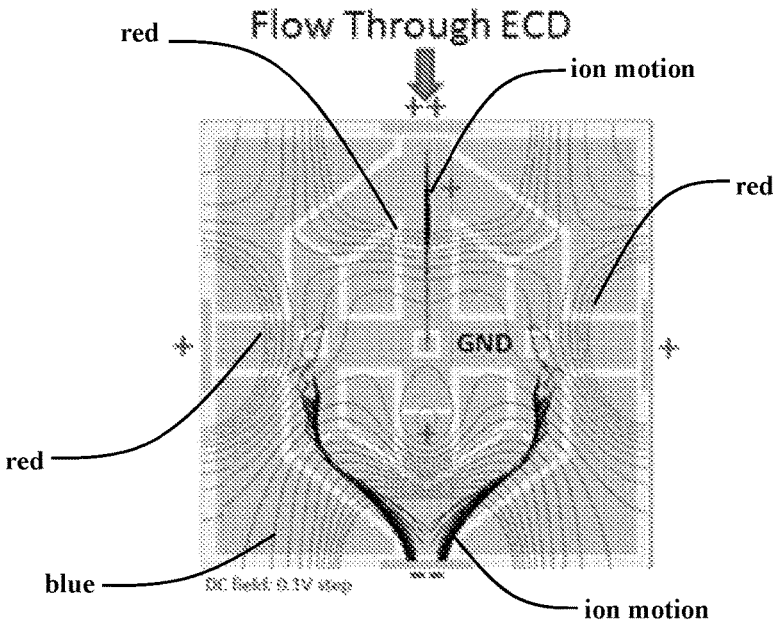
Figure 12D:
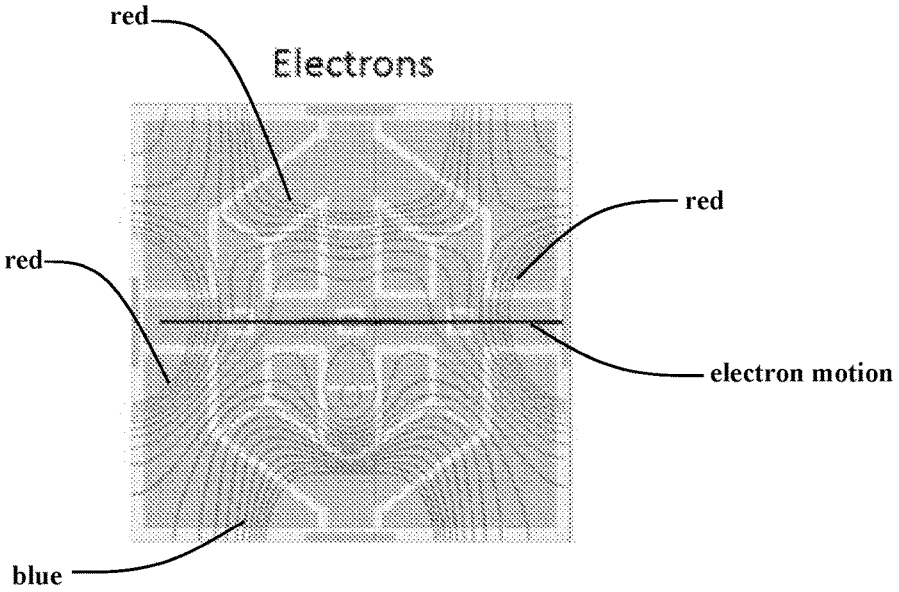

With reference now to FIGS. 12A-D, another exemplary ion reaction device 1200 in accordance with various aspects of the present teachings is schematically depicted. Like the ion reaction devices of FIGS. 10 and 11, the ion reaction device 1200 comprises a plurality of substantially planar electrodes disposed in a parallel orientation that define a plurality of ion pathways therebetween. As shown in FIG. 12A, each PCB can comprise a plurality of electrodes defining a first pathway extending at least partially along a first central axis (A), a second pathway extending along a second central axis (B), and two, third pathways at least partially extending along a third axis ($C_1$, $C_2$). The equipotential lines in FIG. 12A show RF field potential (the red lines and the blue lines indicate different phases of RF). The equipotential lines in FIGS. 12B-D show DC field potential (the red lines show positive and the blue lines show negative potential)

The ions initially injected along the first pathway are transmitted along the first pathway toward the first intersection point 1212 with the second pathway. Unlike the other ion reaction devices described herein, however, the ions can flow through the device (e.g., without being substantially diverted from the first pathway (e.g., for conventional MS/CID analysis, as shown in FIG. 12B)), or alternatively, a DC voltage can be applied to an electrode (e.g., electrode 1260*c* at or adjacent the first intersection point 1212 and along the first pathway) to divert the ions from the first pathway in both orthogonal directions along the second pathway (i.e., the pathway along which charged species can be transmitted as shown in FIG. 12D), prior to being diverted along at least one third pathway that at least partially extends along at least one third central axis orthogonal to the second central axis at the second intersection points 1223*a,b* (as shown in FIG. 12C).

The ions initially injected along the first pathway are transmitted along the first pathway toward the first intersection point 1212 with the second pathway, initially under the influence of the electrodes 1210*a-d* to which an RF signal is provided to substantially focus the ions along the central axis (A). By way of example, the inverted phase of the signal applied to electrodes 1210*a* and 1210*b* (which surround electrode 1260*a*) maintain the ions substantially along the central axis (A) as they enter the ion reaction device 1200. In a MS/CID mode of operation in which the ions merely flow through the reaction cell 1200 (e.g., without undergoing ECD), a repulsive potential DC potential (e.g., +1V) can also be applied to one or more of the lens electrode 1201, plate electrodes 1205*a,b*, and electrode 1260*a*, such that the trajectory of the ions is maintained substantially toward electrodes 1260*c,d* (maintained at an attractive potential (e.g. −1 V)), and electrode 1203 (maintained at an attractive potential to the ions (e.g., −2V)), as shown in FIG. 12B.

When it is desired for an ECD reaction to be performed, for example, a controller can activate a charged species source (which as discussed otherwise herein transmits a charged reagent species along the second pathway, as shown in FIG. 12*d*) and switch the voltage of one or more electrodes along the first ion pathway such that ions are deflected therefrom. For example, as shown in FIG. 12, the voltage of electrode 1260*c* can be switched from −1V to +10V, which can be effective to deflect the ions along the second pathway, as shown in FIG. 12C. The lens electrodes 1205*a,b* can be maintained at the repulsive potential such that the ions are again deflected along the third pathways toward the attractive electrode 1203 at intersection points 1223*a,b*. That is, as shown in FIG. 12C, the third pathway can comprise two offset pathways, each of which extends at least partially along a central axis ($C_1$, $C_2$) substantially orthogonal to the second pathway and that intersects the second pathway at second intersection points 1223*a,b*, respectively.

In various embodiments, electron control optics and ion control optics are completely separated, so independent operations on both charged particles are possible. For electrons, electron energy can be controlled by the potential difference between the electron source and the intersection point between the ion pathway and the charged species pathway. The charged species pathway can be controlled in an ON/OFF fashion by use of a gate electrode. Lens can be positioned at or proximate either axial end of the second pathway and when positively biased, cause the charged species, when such species are electrons, to focus. Ions which are introduced through the other pathway are stable near theses lens since they are biased positively.

It should be appreciated that numerous changes can be made to the disclosed embodiments without departing from the scope of the present teachings. While the foregoing figures and examples refer to specific elements, this is intended to be by way of example and illustration only and not by way of limitation. It should be appreciated by the person skilled in the art that various changes can be made in form and details to the disclosed embodiments without departing from the scope of the teachings encompassed by the appended claims.

The invention claimed is:

1. An ion reaction apparatus, comprising:

a first plurality of electrodes arranged to define a first pathway therebetween, the first pathway comprising a first axial end configured to receive ions from an ion source and a second axial end disposed at a distance from the first axial end of the first pathway extending at least partially along a first central axis;

a second plurality of electrodes arranged to define a second pathway extending along a second central axis, said second pathway intersecting the first pathway at a first intersection point, the second central axis being substantially orthogonal to the first central axis;

a third plurality of electrodes arranged to define a third pathway therebetween, the third pathway comprising a first axial end and a second axial end disposed at a distance from the first axial end of the third pathway to transmit at least one of ions and reaction products of said ions out of the ion reaction apparatus, said third pathway extending at least partially along a third central axis substantially orthogonal to the second central axis and intersecting the second pathway at a second intersection point spaced a distance apart from the first intersection point, wherein the first, second, and third plurality of electrodes are configured to couple to an RF voltage source that provides an RF voltage to each of electrodes of the first, second, and third plurality of electrodes; and a charged species source for introducing a charged species into the second pathway along the second central axis extending between the first and second intersection points.

2. The apparatus of claim 1, wherein said ions interact with said charged species substantially along the second pathway.

3. The apparatus of claim 2, wherein said interaction length is at least about 10 mm, and optionally wherein the interaction causes electron induced dissociation.

4. The apparatus of claim 1, wherein said first central axis and said third central axis are parallel; and optionally wherein the first axial end of the first pathway and the second axial end of the third pathway are collinear.

5. The apparatus of claim 1, wherein the first central axis and the second central axis extend through the first intersection point, and wherein the second central axis and the third central axis extend through the second intersection point, and optionally wherein the second pathway extends between a first axial end and a second axial end disposed at a distance from the first axial end of the second pathway, the charged species source being disposed at or proximate one of the first or second axial end of the second pathway.

6. The apparatus of claim 5, further comprising a fourth plurality of electrodes arranged around said first central axis and disposed on an opposed side of the second central axis from the first plurality of electrodes.

7. The apparatus of claim 6, wherein at least one of the first plurality of electrodes also comprises one of the second plurality of electrodes and wherein at least one of the fourth plurality of electrodes also comprises one of the second plurality of electrodes.

8. The apparatus of claim 6, wherein the controller is configured to deliver voltage to said first and fourth plurality of electrodes such that each electrode in said first plurality of electrodes is paired with another electrode in said first plurality of electrodes to form an electrode pair such that one electrode in each electrode pair of said first plurality of electrodes has the same polarity and is directly opposite across the first central axis of the other electrode in the electrode pair of said first plurality of electrodes, wherein each electrode in said fourth plurality of electrodes is paired with another electrode in said fourth plurality of electrodes to form an electrode pair such that one electrode in each electrode pair of said fourth plurality of electrodes has the same polarity and is directly opposite across the first central axis of the other electrode in the electrode pair of said fourth plurality of electrodes, wherein each electrode in said first plurality of electrodes is paired with an electrode in said fourth plurality of electrodes to form an electrode pair such that each electrode in each electrode pair of said first and fourth plurality of electrodes has opposite polarity and is directly opposite across the first intersection point of the other electrode in the electrode pair of said first and fourth plurality of electrodes, and wherein the RF fields generated between said first intersection point and said first plurality of electrodes is in reverse phase to the RF fields generated between said first intersection point and said fourth plurality of electrodes.

9. The apparatus of claim 6, further comprising a fifth plurality of electrodes arranged around said third central axis and disposed on an opposed side of the third central axis from the third plurality of electrodes.

10. The apparatus of claim 9, wherein at least one of the third plurality of electrodes also comprises one of the second plurality of electrodes and wherein at least one of the fifth plurality of electrodes also comprises one of the second plurality of electrodes.

11. The apparatus of claim 9, wherein the controller is configured to deliver voltage to said third and fifth plurality of electrodes such that each electrode in said third plurality of electrodes is paired with another electrode in said third plurality of electrodes to form an electrode pair such that one electrode in each electrode pair of said third plurality of electrodes has the same polarity and is directly opposite across the third central axis of the other electrode in the electrode pair of said third plurality of electrodes, wherein each electrode in said fifth plurality of electrodes is paired with another electrode in said fifth plurality of electrodes to form an electrode pair such that one electrode in each electrode pair of said fifth plurality of electrodes has the same polarity and is directly opposite across the third central axis of the other electrode in the electrode pair of said fifth plurality of electrodes, wherein each electrode in said third plurality of electrodes is paired with an electrode in said fifth plurality of electrodes to form an electrode pair such that each electrode in each electrode pair of said third and fifth plurality of electrodes has opposite polarity and is directly opposite across the second intersection point of the other electrode in the electrode pair of said third and fifth plurality of electrodes, and wherein the RF fields generated between said second intersection point and said third plurality of electrodes is in reverse phase to the RF fields generated between said second intersection point and said fifth plurality of electrodes.

12. The apparatus of claim 11, wherein said ions are positively charged and said charged species are electrons.

13. The apparatus of claim 1, wherein the first plurality of electrodes comprise a set of quadrupole electrodes arranged in a quadrupole orientation around said first central axis, said first set of electrodes for guiding ions along the first pathway, wherein the second plurality of electrodes comprise a set of quadrupole electrodes arranged in a quadrupole orientation around said second central axis, said second set of electrodes for guiding ions along the second pathway, and wherein the third plurality of electrodes comprise a set of quadrupole electrodes arranged in a quadrupole orientation around said third central axis, said third set of electrodes for guiding ions along the third pathway.

14. The apparatus of claim 1, further comprising:

a voltage source for providing an RF voltage to said first, second, and third plurality of electrodes to generate an RF field; and a controller for controlling said RF voltages, and optionally further comprising an ion source disposed at or proximate the first axial end of said first pathway for introducing the ions along the first central axis.

15. The apparatus of claim 1, further comprising a magnetic field generator that generates a magnetic field parallel to and along said second central axis, and optionally wherein said charged species are reagent anions.

16. The apparatus of claim 1, further comprising:

a gate electrode disposed at said first axial end of the first pathway for controlling the introduction of said ions;

an electrode disposed at said second axial end of the first pathway, said electrode having a DC potential applied thereto of the same polarity as said ions;

a gate electrode disposed at said second axial end of the third pathway for controlling the removal of at least one of said ions and reaction products of said ions; and an electrode disposed at said first axial end of the third pathway, said gate having a DC potential applied thereto of the same polarity as said ions.

17. The apparatus of claim 1, wherein said second pathway comprises lenses disposed at or proximate at least one of the axial ends of said second pathway for focusing said charged species, and optionally wherein a laser source is disposed at or proximate to an axial end of the second pathway opposite said charged species source, said laser source for providing energy to said ions or said charged species.

18. The apparatus of claim 1, wherein the first, second, and third plurality of electrodes comprise a plurality of solid, rod-type electrodes, and optionally wherein the first, second, and third plurality of electrodes comprise a plurality of substantially planar electrodes formed on a printed circuit board.

19. A method for performing an ion reaction, comprising:

introducing a plurality of ions into a first pathway extending at least partially along a first central axis and defined by a first plurality of electrodes, the first pathway comprising a first axial end configured to receive ions from an ion source and a second axial end disposed at a distance from the first axial end of the first pathway;

transmitting the ions into a second pathway extending along a second central axis and defined by a second plurality of electrodes, said second pathway intersecting the first pathway at a first intersection point, the second central axis being substantially orthogonal to the first central axis;

transmitting the ions into a third pathway extending along a third central axis and defined by a third plurality of electrodes, said third pathway intersecting the second pathway at a second intersection point spaced a distance apart from the first intersection point, the third central axis being substantially orthogonal to the second central axis; and introducing a charged species into the second pathway along the second central axis extending between the first and second intersection points to allow the ions transmitted along the second pathway and the charged species to interact.

20. The method of claim 19, further comprising providing a magnetic field parallel to said second central axis, optionally further comprising providing RF voltages to electrodes of the first, second, and third pluralities of electrodes, optionally wherein the ions are positively charged and the charged species comprises electrons, and optionally further comprising focusing said charged species with lenses disposed at or proximate one or more axial ends of said second pathway.

* * * * *